US008662433B2

(12) United States Patent
Huffman et al.

(10) Patent No.: US 8,662,433 B2
(45) Date of Patent: Mar. 4, 2014

(54) REEL-IN-BOX CABLE PACKAGE

(75) Inventors: Jason Huffman, Maiden, NC (US); Eddy Robert Houston, Claremont, NC (US); Larry Lynn Bleich, Hickory, NC (US)

(73) Assignee: CommScope, Inc. of North Carolina, Hickory, NC (US)

( * ) Notice: Subject to any disclaimer, the term of this patent is extended or adjusted under 35 U.S.C. 154(b) by 383 days.

(21) Appl. No.: 12/964,977

(22) Filed: Dec. 10, 2010

(65) Prior Publication Data

US 2011/0147249 A1 Jun. 23, 2011

Related U.S. Application Data

(60) Provisional application No. 61/287,877, filed on Dec. 18, 2009, provisional application No. 61/324,408, filed on Apr. 15, 2010.

(51) Int. Cl.
*B65D 85/04* (2006.01)
*B65H 75/00* (2006.01)
*B65H 49/32* (2006.01)

(52) U.S. Cl.
USPC ..... 242/171; 242/588.2; 242/588.4; 242/588.6; 242/598.3; 242/598.6; 242/129; 242/129.6

(58) Field of Classification Search
USPC ..... 242/170, 171, 588, 588.2, 588.3, 588.4, 242/588.6, 598, 598.3, 598.5, 598.6, 129, 242/129.6; 206/395
See application file for complete search history.

(56) References Cited

U.S. PATENT DOCUMENTS

| | | | | |
|---|---|---|---|---|
| 4,168,778 | A * | 9/1979 | Buxton | 206/409 |
| 5,529,186 | A * | 6/1996 | Bass | 206/395 |
| 2002/0125161 | A1 * | 9/2002 | Cote | 206/408 |
| 2007/0295847 | A1 * | 12/2007 | Weck et al. | 242/170 |

* cited by examiner

*Primary Examiner* — William E Dondero
(74) *Attorney, Agent, or Firm* — Myers Bigel Sibley & Sajovec, P.A.

(57) ABSTRACT

A communications cable reel package includes a box having a bottom, first, second, third and fourth side walls, and a top, wherein the first and second side walls are opposing side walls, and wherein each of the first and second side walls includes a slot with an open upper end. The package further comprises: an axle member mounted in the slots; a spool mounted on the axle member; and communications cable wound onto the spool.

12 Claims, 11 Drawing Sheets

REEL-IN-BOX CABLE PACKAGE

RELATED APPLICATIONS

This application claims priority from U.S. Provisional Patent Application No. 61/287,877, filed Dec. 18, 2010, and from U.S. Provisional Patent Application No. 61/324,408, filed Apr. 10, 2010, the disclosures of which are hereby incorporated herein by reference.

FIELD OF THE INVENTION

The present invention is directed generally to packaging, and more specifically to packaging of cable.

BACKGROUND

Communications cable may be packaged in a number of ways. Often communications cable is wound onto a reel or spool, from which it can easily be unwound for use as needed.

One packaging technique employs a "reel-in-box" configuration. As the name implies, the package includes a box in which a reel of cable is mounted. Inside the box, a reel wound with cable is mounted onto a horizontal post, which is in turn mounted onto plastic endplates within the box. The reel is free to rotate on the post. In use, cable can be fed from the reel through an opening in the box (for example, the lid may be removed from the box or opened). Reel-in-box packaging can be advantageous for shipping (as the shape of the box is convenient for shipping) and for feeding of the cable, as the box can provide a stationary location from which the cable is fed.

It may be desirable to provide new configurations for reel-in-box packages.

SUMMARY

As a first aspect, embodiments of the present invention are directed to a communications cable reel package. The package comprises a box having a bottom, first, second, third and fourth side walls, and a top, wherein the first and second side walls are opposing side walls, and wherein each of the first and second side walls includes a slot with an open upper end. The package further comprises: an axle member mounted in the slots; a spool mounted on the axle member; and communications cable wound onto the spool. This configuration can provide a cost-effective reel-in-box package for communications cable.

As a second aspect, embodiments of the present invention are directed to a communications cable reel package, comprising: a box having a bottom, first, second, third and fourth side walls, and a top; an axle member mounted in the housing; a spool mounted on the axle member; and cable wound onto the spool. One of the housing side walls includes a pay-out aperture, the pay-out aperture being generally rectangular in shape, with slightly rounded lower corners and more prominently rounded upper corners.

As a third aspect, embodiments of the present invention are directed to a communications cable reel package, comprising a box having a bottom, first, second, third and fourth side walls, and a top. The first and second side walls are opposing side walls, and each of the first and second side walls includes a slot with an open upper end. The package further comprises: an axle member mounted in the slots; a spool mounted on the axle member; and communications cable wound onto the spool. Each of the first and second side walls comprises first and second contiguous overlying panels, the slot being present only in the second panel. Each of the first and second side walls further comprises a pair of reinforcing panels, each of the reinforcing panels having a recess that aligns with a bottom end of the slot to thereby support the axle from underneath. The first and second panels are contiguous, the pair of reinforcing panels are contiguous, and one of the pair of reinforcing panels is contiguous with the second panel.

As a fourth aspect, embodiments of the present invention are directed to a communications cable reel package, comprising: a box having a bottom, first, second, third and fourth side walls, and a top, wherein the first and second side walls are opposing side walls, and wherein each of the first and second side walls includes a slot with an open upper end; an axle member mounted in the slots; a spool mounted on the axle member; and communications cable wound onto the spool. Each of the first and second side walls comprises first and second contiguous overlying panels, the slot being present only in the second panel. Each of the first and second walls further comprises a pair of reinforcing panels, wherein each panel of the pair of reinforcing panels is contiguous with the other panel of the pair, and wherein one of the pair of each reinforcing panel is contiguous with a respective second panel. A tab extends from one end of the slot and overlies upper edges of the reinforcing panels.

DETAILED DESCRIPTION OF EMBODIMENTS OF THE INVENTION

Figure 1:
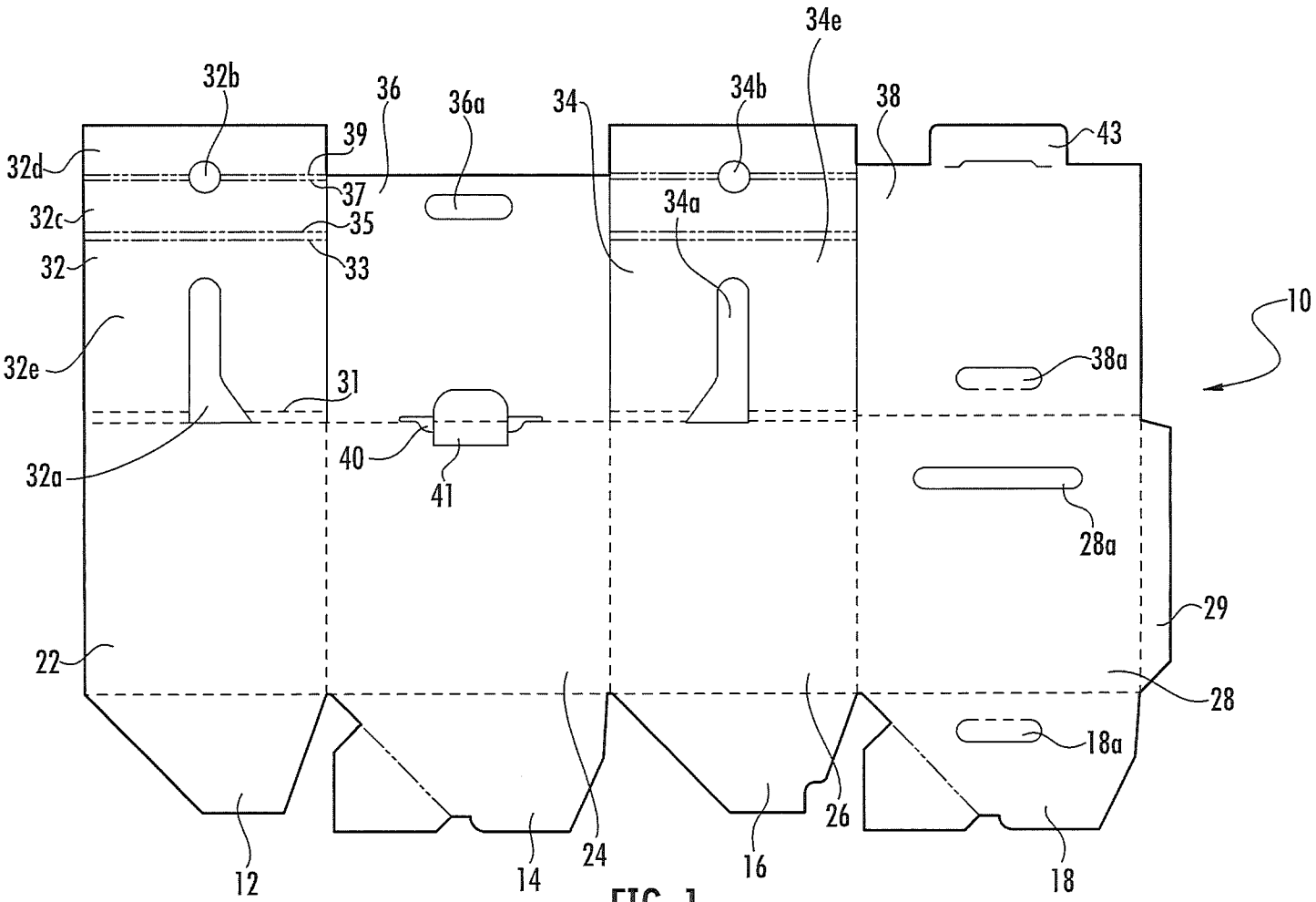
FIG. 1 is a plan view of a blank for a box according to embodiments of the present invention.

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" or "above" the other elements or features. Thus, the exemplary term "under" can encompass both an orientation of over and under. The device may be otherwise oriented (rotated 90 degrees or at other orientations) and the spatially relative descriptors used herein interpreted accordingly. As used herein, "vertical" has the conventional meaning, i.e., upright; or at a right angle to the horizon.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

Where used, the terms "attached", "connected", "interconnected", "contacting", "mounted" and the like can mean either direct or indirect attachment or contact between elements, unless stated otherwise.

Turning now to the figures, a flat blank for a box, designated broadly at 10, is shown in FIG. 1. The blank 10 includes bottom panels 12, 14, 16, 18, side wall panels 22, 24, 26, 28, slot panels 32, 34, and top flaps 36, 38. The arrangement of these panels is discussed below.

Each of the bottom panels 12, 14, 16, 18 shares an edge and is contiguous with a respective side panel 22, 24, 26, 28. The edges are represented in FIG. 1 by a broken line, which in practice typically is a scored, slitted or perforated fold line in the blank 10 along which one panel is folded relative to the adjoining contiguous panel. As used herein with respect to panels, the term "contiguous" is intended to mean that the panels share an edge when the blank 10 is folded into a final structure. In some instances (such as the bottom panel 12 and side panel 22), the contiguous panels are divided by a single fold line; in other instances (such as the side panel 22 and slot panel 32 described below), "contiguous" panels are separated by two fold lines because the panels are folded 180 degrees relative to each other and the presence of the two fold lines accounts for the thickness of the blank material. Both of these configurations are intended to be covered by the term "contiguous."

Figure 2:
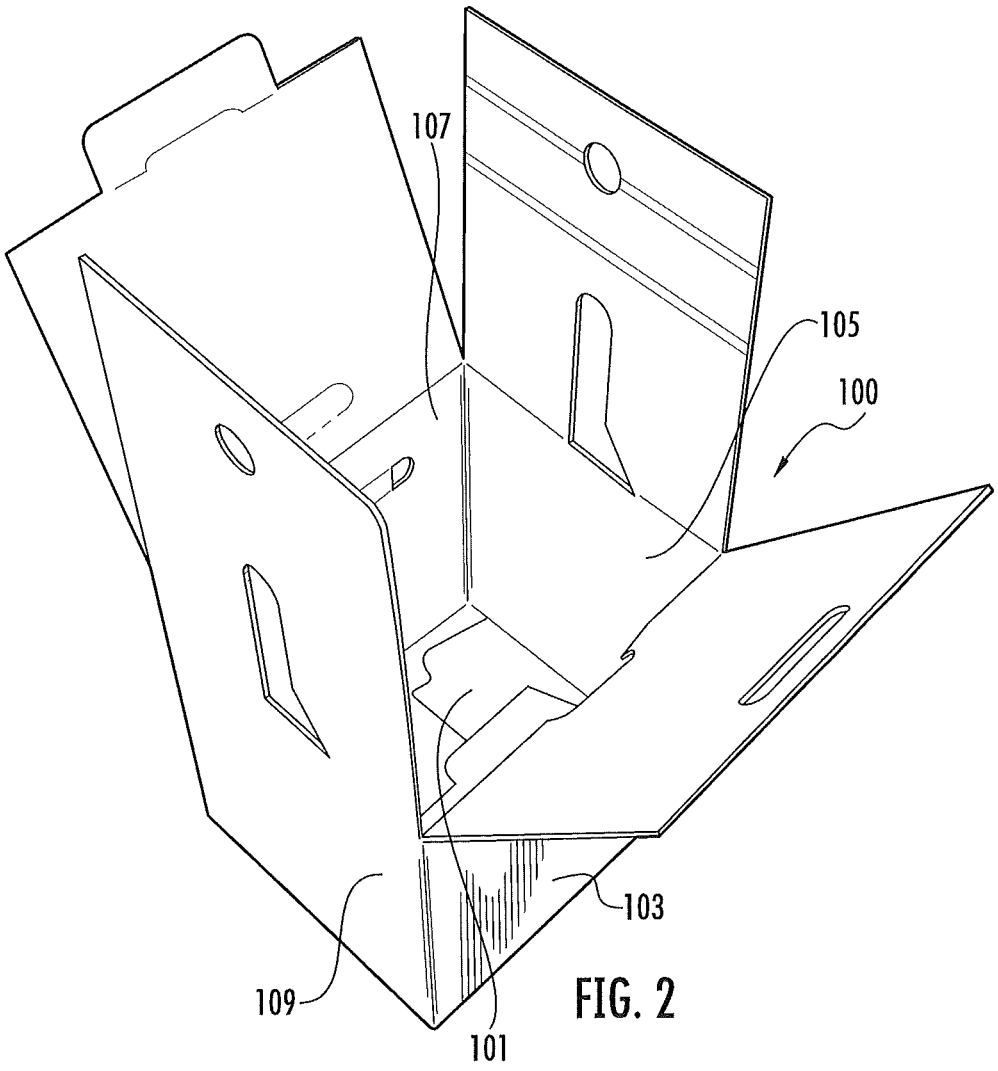
FIGS. 2-8 are sequential views of the box of FIG. 1 being assembled.

The bottom panels 12, 14, 16, 18 are shaped such that they can be brought together to interlock to form the bottom side of a box (designated at 100—see FIG. 2). Those skilled in this art will appreciate that interlocking panels of this type are known and need not be described in detail herein. The bottom panel 18 also includes an oblong handle aperture 18*a*.

The side wall panel 22 shares a vertical edge and is contiguous with side wall panel 24. Side wall panel 24 shares a vertical edge and is contiguous with side wall panel 26, which in turn shares a vertical edge and is contiguous with side wall panel 28. Side wall panel 28 is attached at its other vertical edge to a flap 29. Side wall panel 28 includes an oblong aperture 28*a*. A portion of a payout aperture 40 is located at the upper edge of the side wall panel 24.

Slot panels 32, 34 share an edge with, respectively, the side wall panels 22, 26. Each slot panel 32, 34 includes multiple fold lines 31, 33, 35, 37, 39. A respective vertical slot 32*a*, 34*a* extends from the edge that each slot panel 32, 34 shares with a side wall panel 22, 26 and extends therefrom to a central portion of the slot panel 32, 34. A round support aperture 32*b*, 34*b* is present in each slot panel 32, 34 on the fold lines 37, 39. The fold lines 31, 33, 35, 37, 39 of slot panel 32 subdivide the slot panel 32 into a main portion 32*e*, a portion 32*c* and a free end 32*d*, which are serially contiguous. The fold lines 31, 33, 35, 37, 39 of slot panel 34 subdivide the slot panel 34 into a main portion 34*e*, a portion 34*c* and a free end 34*d*, which are also serially contiguous.

The top panel 36 shares an edge with the side wall panel 24, where the remainder of the payout aperture 40 extends into the top panel 36. A flap 41 fills much of the payout aperture 40. A handle aperture 36*a* is located near the opposite edge. The top panel 38 shares an edge with the side wall panel 28 and has a flap 43 on its opposite edge. A handle aperture 38*a* is located near the side wall panel 28.

The blank 10 can be folded into a box 100 (see FIGS. 2-8) in the following manner. The blank 10 is bent at right angles along the edges shared by the side wall panels 22, 24, 26, 28. This action brings the bottom panels 12, 14, 16, 18 together to interlock to form the bottom 101 and side walls 103, 105, 107, 109 of the box 100 (FIG. 2). The flap 29 can be inserted on the inside of the box to rest against the side panel 22.

Figure 3:
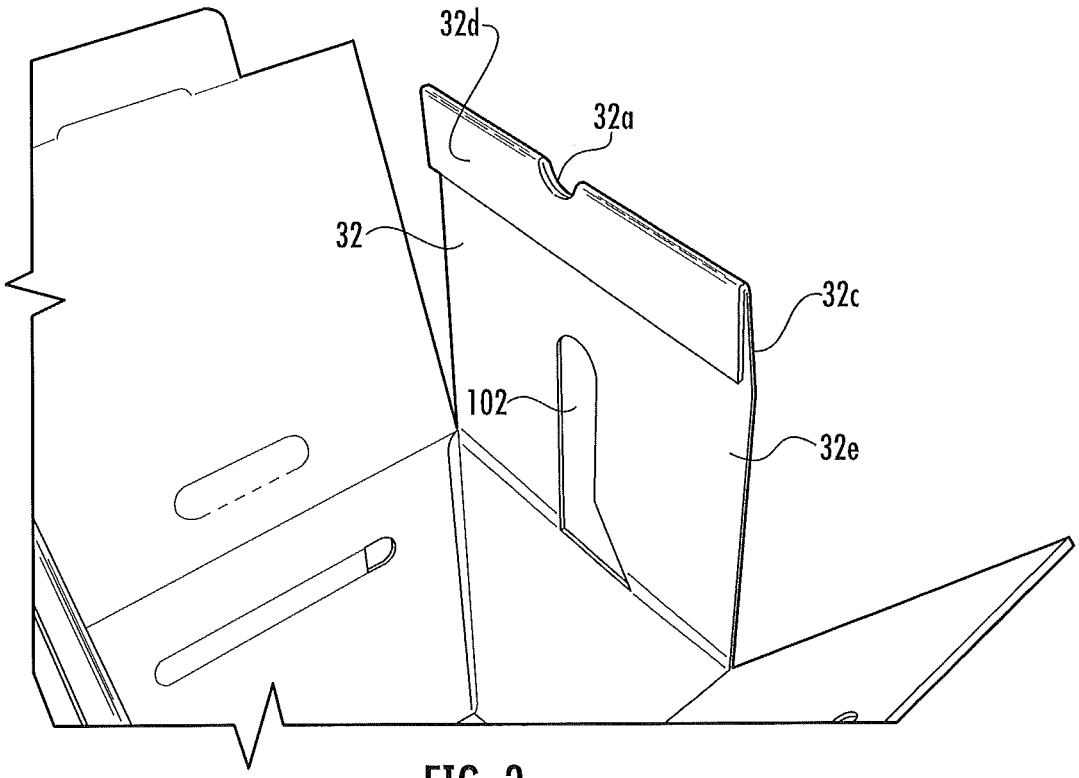
Figure 4:
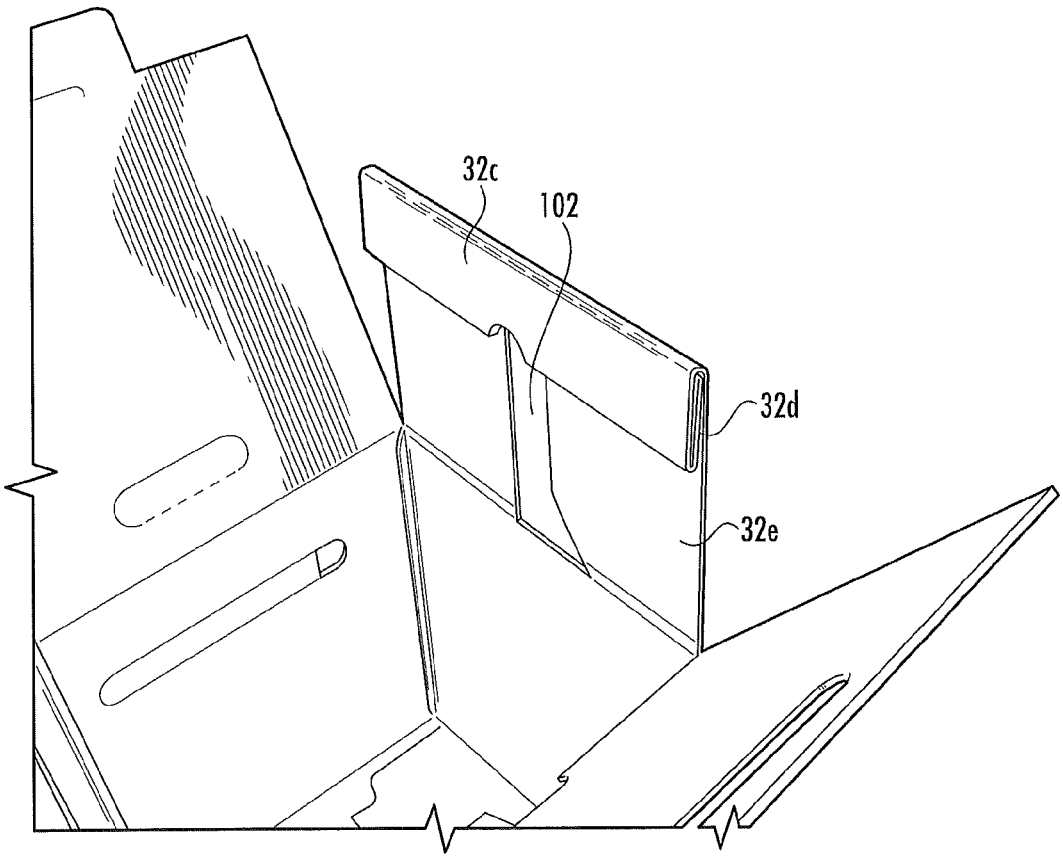
Figure 5:
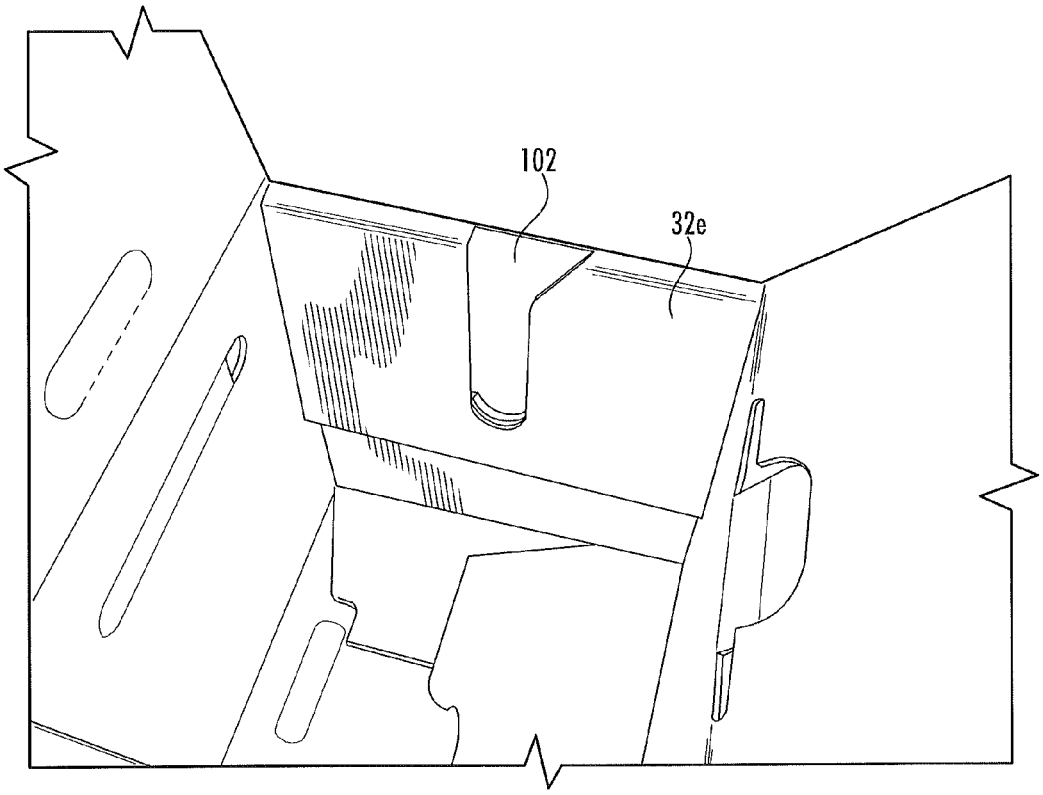

The slot panel 32 is then bent along the fold lines 37, 39, with the result that the free end 32*d* of the slot panel 32 is folded under the portion 32*c* of the slot panel 32 between the fold lines 35, 37 (FIG. 3). The slot panel 32 is then folded along fold lines 33, 35 so that portion 32*c* and free end 32*d* are folded under the main portion 32*e* of the slot panel 32 (FIG. 4). The round support aperture 32*b* is split between the portion 32*c* and the free end 32*d* such that the split halves align with the bottom of the slot 32*a*. These folds produce a slot 102 in the side wall of the box 100 (FIG. 5) that is open at its top end and that has three serially contiguous panels as layers of reinforcement (from the main portion 32*a* slot panel 32, the portion 32*c*, and the free end 32*b*) at its bottom end.

Figure 6:
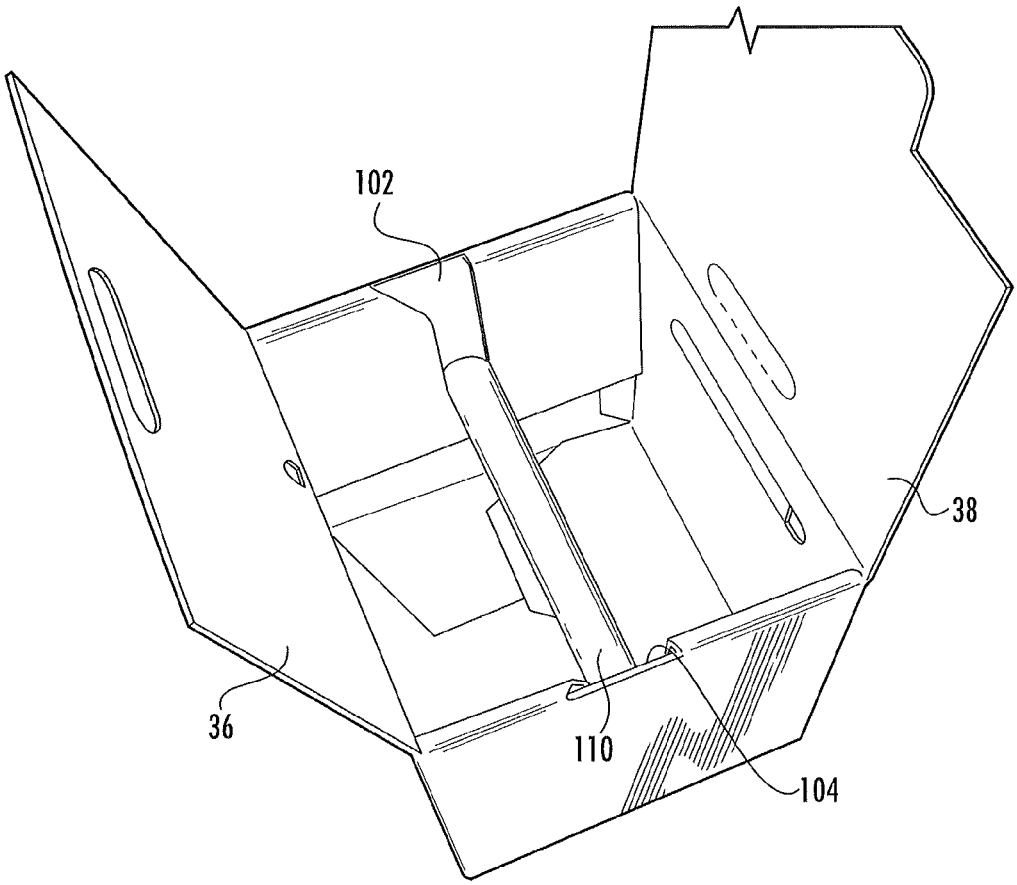

Similar folds are then made along the fold lines 31, 33, 35, 37, 39 on the slot panel 34 to produce a slot 104 on the opposite side of the box 100 that is also open at the top end and triply reinforced at the bottom end (FIG. 6).

Finally, the top panel 36 can be folded to cover the cavity of the box 100, and the top panel 38 can be folded over the top panel 36 (FIG. 8), with the flap 43 being inserted into the payout aperture 140 and the flap 41 being inserted into a slot in the flap 43.

Figure 7:
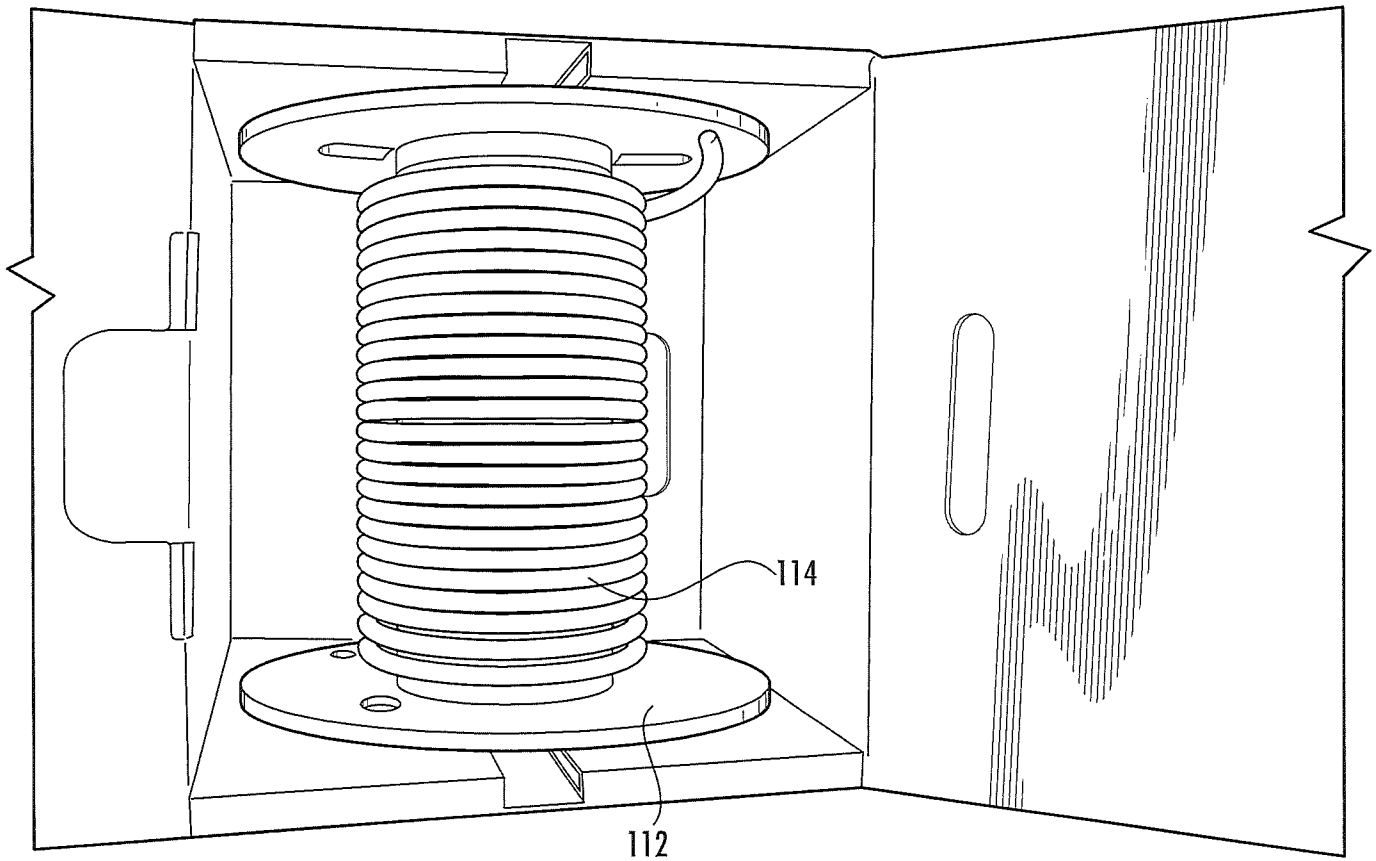
Figure 8:
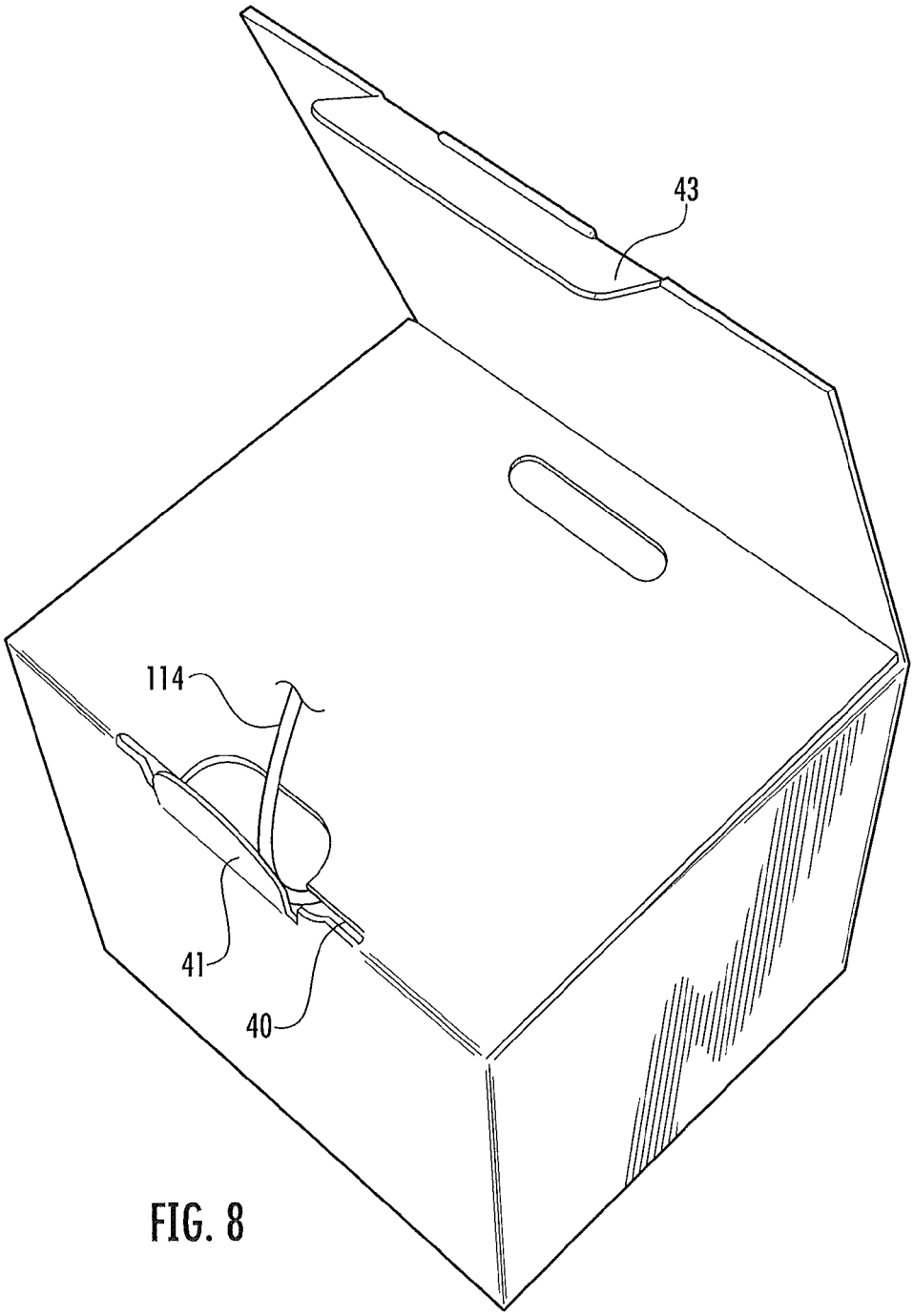

As shown in FIG. 6, with the top panels 36, 38 lifted, a tube 110 can be inserted into the upper ends of the slots 102, 104 and slid into place, such that the ends of the tube 110 rest on the folded edges of the support apertures 32*d*, 34*b* and the bottom ends of the slots 32*a*, 34*a*. As shown in FIG. 7, the tube 110 would ordinarily be inserted through a spool 112 carrying a cable 114, then inserted into the slots 102, 104 to serve as an axle for the spool 112. The cable 114 can be routed through the payout aperture 140 once the box is closed (FIG. 8).

The box 100 can provide a reel-in-box cable package that is less expensive than conventional packages, because it lacks the plastic endplates typically included in such packages that support the spool 112. In addition, the placement of the payout aperture 140 in the upper end of the box 100 can provide a package that is very stable during payout.

Figure 9:
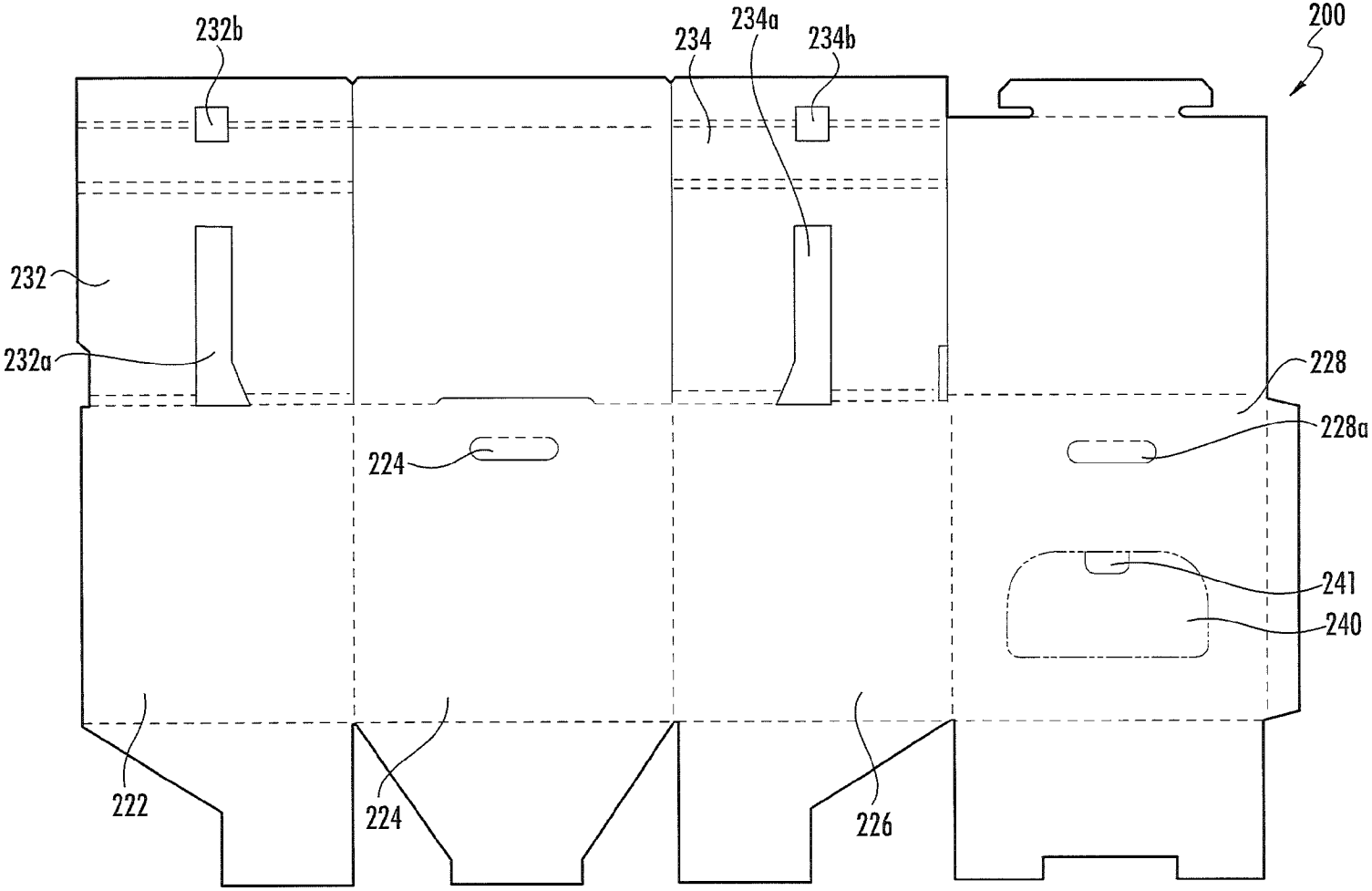
FIG. 9 is a plan view of a blank for a box according to alternative embodiments of the present invention.

Referring now to FIG. 9, another embodiment of a blank for a box, designated broadly at 200, is shown therein. The blank 200 is very similar to the blank 10 described above with the three exceptions. First, the blank 200 includes slots 232*a*, 234*a* in panels 232, 234 that have "squared" or right-angled ends, rather than rounded ends like those of slots 32*a*, 34*a*, and the blank 200 also includes square holes 232*b*, 234*b* (rather than round holes) that, when the blank 200 is folded, provide support for a tube on which a spool is positioned. Second, oblong holes 224*a*, 228*a* are provided in panels 224, 228 for handles.

Third, the panel 228 includes a large tab 240. The large tab 240 is generally rectangular, with slightly rounded lower corners and much more prominently rounded upper corners. The large tab 240 is defined by perforations, slits or the like to facilitate smooth tearing. A small tab 241 (also defined by perforations or the like) extends from the upper edge of the large tab 240.

Figure 10:
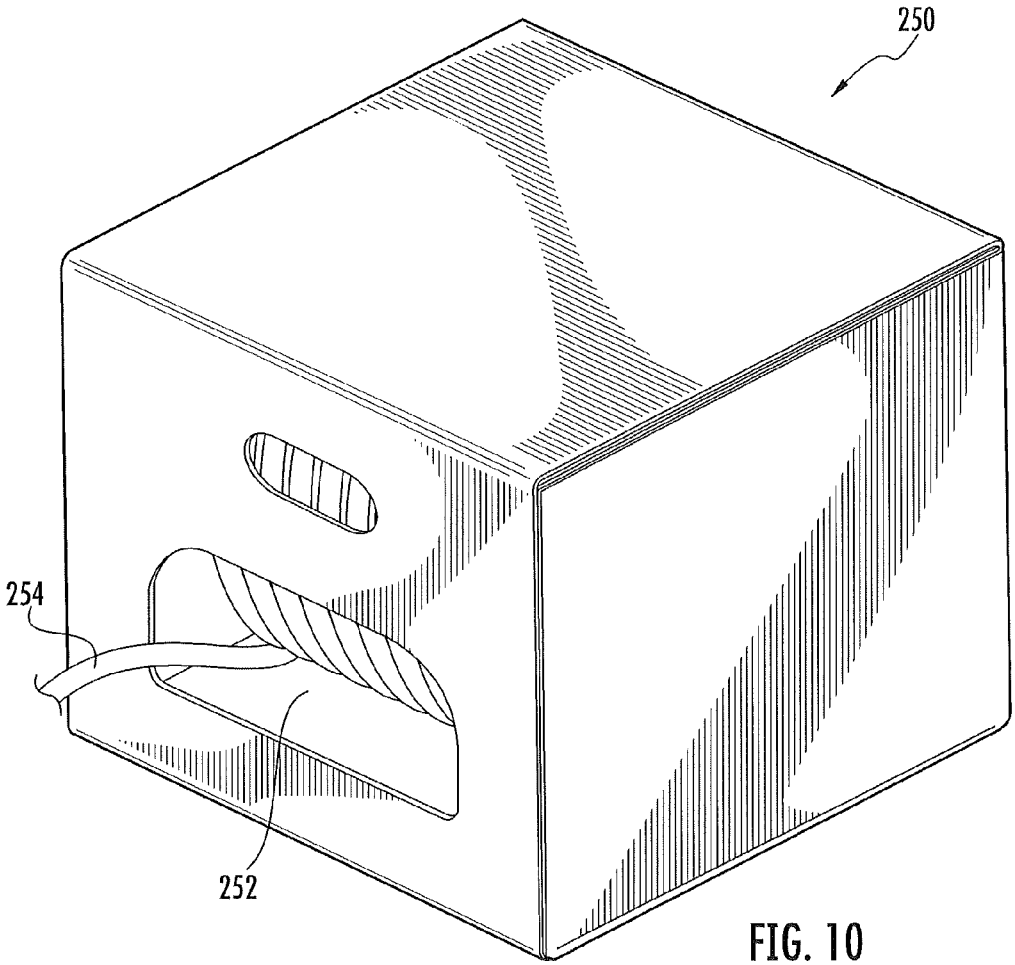
FIG. 10 is a perspective view of the box of FIG. 9 in an assembled condition.

As shown in FIG. 10, a box 250 can be created by folding the blank 200. Using the small tab 241 as a gripping element, the large tab 240 can be torn away from the panel 228 to create a pay-out aperture 252. A spool of cable 254 can be mounted in the slots 232*a*, 234*a*.

The size of the pay-out aperture 252 can be beneficial to the box 250 for multiple reasons. First, the free end of the cable on a reel is typically secured for shipping, by taping it to the reel, wrapping it in plastic wrap, or the like. The size of the payout aperture 252 can enable an operator to free the end of the cable through the payout aperture 252 without having to open the top panel of the box 250. Second, the relative width of the payout aperture 252 can enable cable paying out from a spool mounted between the slots 232*a*, 234*a* to traverse the width of the pay-out aperture 252 as it is unreeled from the spool. This configuration can provide a smoother pay-out of the cable. Third, the height and width of the pay-out aperture 252 can enable an operator to easily access the cable reel. For example, if too much cable has been paid out and the operator wishes to return the excess cable to the reel, the pay-out aperture 252 may be sufficiently spacious to allow the operator's hands to manipulate the reel. Fourth, the pay-out aperture 252 may be sufficiently large to provide visual access to the cable remaining on the reel, which can enable the operator to quickly assess the amount of cable remaining. In some embodiments, the pay-out aperture may be between about 7 and 10 inches in width and about 3.5 to 6 inches in height.

Figure 11:
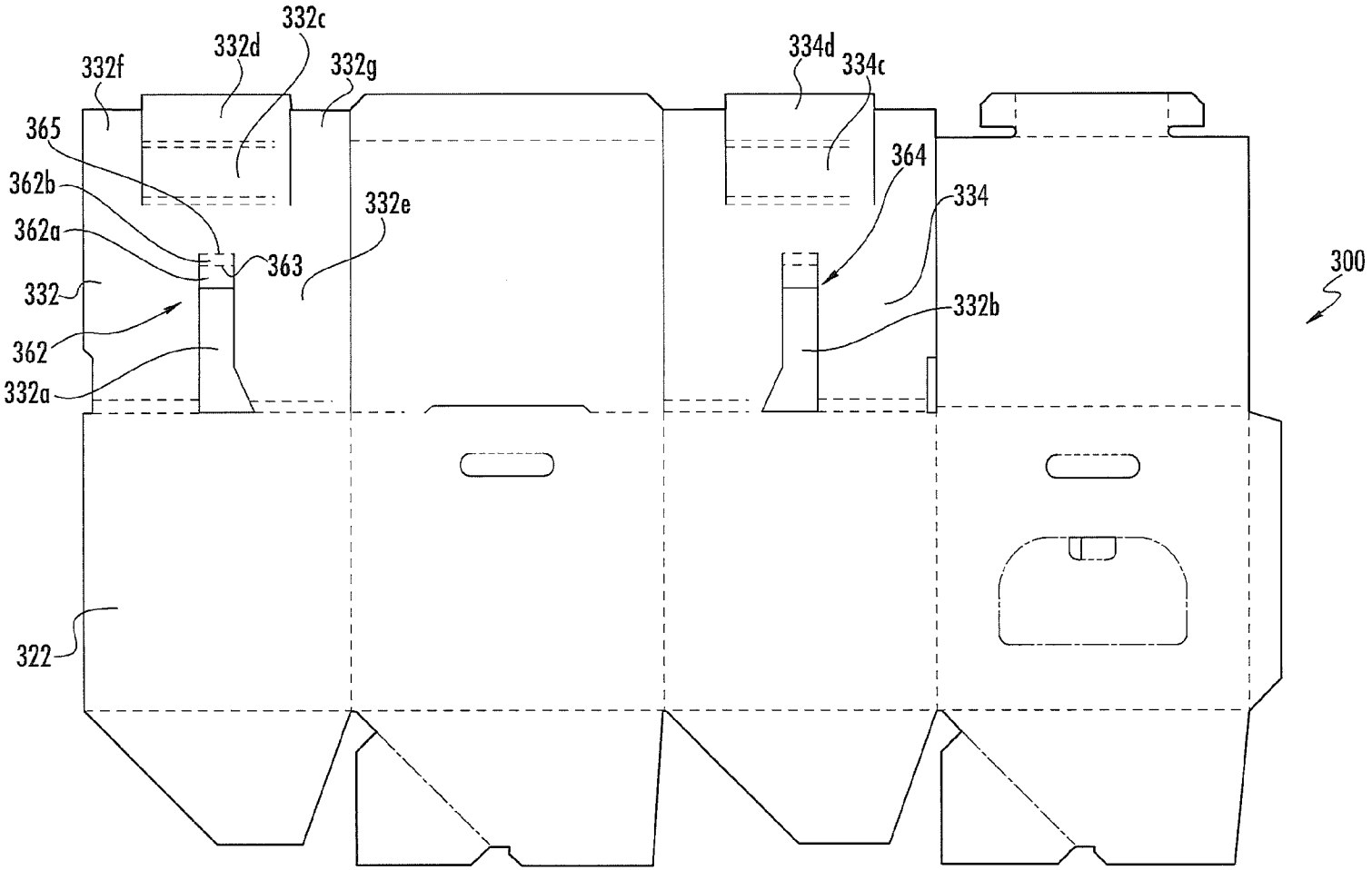
FIG. 11 is a plan view of a blank for a box according to another embodiment of the present invention.

Referring now to FIG. 11, a blank 300 is shown therein. The blank 300 is similar to the blank 200 with the exception of the formation of the slot panels 332, 334. Using panel 332 as an example, the panels 332*d*, 332*c* do not extend the full width of the panel 332, but instead terminate a short distance from the side edges of the panel 332. When the panels 332*d*, 332*c* are folded in the manner described above, there remain supports 332*f*, 332*g* on either side of the panel 332 that contact the bottom of the box and that can provide additional rigidity to the structure.

Also, there is no hole between panels 332*d*, 332*c* that subsequently forms a reinforcing and supportive edge at the lower end of the slot 332*a*. Instead, a tab 362 is included at the lower end of the slot 332*a*. The tab 362 includes panels 362*a*, 362*b* that are separated by a fold line 363, and the panel 362*a* is separated from the main portion 332*e* of the panel 332 by a fold line 365. Once the panels 332*d*, 332*c* have been folded into place, the tab 362 is folded along the fold line 365 so that the panel 362*b* rests atop the upper edges of the panels 332*d*, 332*c*. The tab 362 is further folded along fold line 363 so that the panel 362*a* rests against the panel 332*c*. Once the panel 332 is folded into place inside the box, the panel 362*a* is captured between the panel 332*c* and the panel 322. The panel 362*b* thus forms the lower edge of the slot 332*a*.

Panel 334 includes similar modifications to the panels 334*c*, 334*d* and includes a tab 364.

Those skilled in this art will appreciate that some embodiments of the invention may lack the slots for supporting a spool, and that other embodiments of the invention may include a pay-out aperture like that described in connection with the box 100 and a second aperture (for operator access) such as that described in connection with the box 200. It will likewise be appreciated that other embodiments may include different combinations of the features of the boxes 100, 250 and the blanks 10, 200 and 300.

The foregoing embodiments are illustrative of the present invention, and are not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention.

That which is claimed is:

1. A communications cable reel package, comprising:

a box having a bottom, first, second, third and fourth side walls, and a top;

wherein the first and second side walls are opposing side walls, and wherein each of the first and second side walls includes a slot with an open upper end;

an axle member mounted in the slots;

a spool mounted on the axle member; and communications cable wound onto the spool;

wherein each of the first and second side walls comprises first and second overlying panels, and wherein the slot is present in only the second panel;

wherein each of the first and second walls further comprises a pair of reinforcing panels, each of the reinforcing panels having a recess that aligns with a bottom end of the slot to thereby support the axle from underneath; and wherein the first and second panels of the first side wall are contiguous and the first and second panels of the second side wall are contiguous, and wherein the respective pairs of reinforcing panels are contiguous, and wherein one panel of each pair of reinforcing panels is contiguous with a respective second panel.

2. The communications cable reel package defined in claim 1, wherein the first and second panels of the first side wall are contiguous, and the first and second panels of the second side wall are contiguous.

3. The communications cable reel package defined in claim 1, wherein the third side wall includes a payout aperture.

4. The communications cable reel package defined in claim 3, wherein the payout aperture is generally rectangular with rounded upper corners.

5. The communications cable reel package defined in claim 1, wherein the third and fourth side walls include handle apertures.

6. The communications cable reel package defined in claim 1, wherein the box is formed of a unitary blank of sheet material.

7. The communications cable reel package defined in claim 1, wherein a bottom end of each slot has right-angled corners.

8. A communications cable reel package, comprising:

a box having a bottom, first, second, third and fourth side walls, and a top;

an axle member mounted in the housing box;

a spool mounted on the axle member; and cable wound onto the spool;

wherein one of the box side walls includes a pay-out aperture, the pay-out aperture being generally rectangular in shape, with rounded lower corners and rounded upper corners;

wherein each of the first and second side walls includes a slot with an open upper end;

wherein each of the first and second side walls comprises first and second overlying panels, and wherein the slot of each of the first and second panels is present in only the second panel wherein the first and second panels are contiguous;

wherein each of the first and second walls further comprises a pair of reinforcing panels, each of the reinforcing panels having a recess that aligns with a bottom end of the slot to thereby support the axle member from underneath; and wherein the first and second panels are contiguous, and wherein the pair of reinforcing panels are contiguous, and wherein one of the pair of reinforcing panels is contiguous with the second panel.

9. The communications cable reel package defined in claim 8, wherein the third and fourth side walls include handle apertures.

10. The communications cable reel package defined in claim 8, wherein the box is formed of a unitary blank of sheet material.

11. The communications cable reel package defined in claim 8, wherein a bottom end of each slot has right-angled corners.

12. A communications cable reel package, comprising:

a box having a bottom, first, second, third and fourth side walls, and a top;

wherein the first and second side walls are opposing side walls, and wherein each of the first and second side walls includes a slot with an open upper end;

an axle member mounted in the slots;

a spool mounted on the axle member; and communications cable wound onto the spool;

wherein each of the first and second side walls comprises first and second contiguous overlying panels, the slot being present only in the second panel; and wherein each of the first and second walls further comprises a pair of reinforcing panels, each of the reinforcing panels having a recess that aligns with a bottom end of the slot to thereby support the axle from underneath, wherein each panel of the pair of reinforcing panels is contiguous with the other panel of the pair, and wherein one of the pair of each reinforcing panel is contiguous with a respective second panel.

* * * * *

UNITED STATES PATENT AND TRADEMARK OFFICE

CERTIFICATE OF CORRECTION

PATENT NO. : 8,662,433 B2
APPLICATION NO. : 12/964977
DATED : March 4, 2014
INVENTOR(S) : Huffman et al.

It is certified that error appears in the above-identified patent and that said Letters Patent is hereby corrected as shown below:

In the Claims:

Column 6, Claim 8, Line 59:

Delete "mounted in the housing box;"

and insert -- mounted in the box; --

Signed and Sealed this
Fourteenth Day of October, 2014

Michelle K. Lee

Michelle K. Lee
*Deputy Director of the United States Patent and Trademark Office*